US007222593B2

(12) United States Patent
Stork et al.

(10) Patent No.: US 7,222,593 B2
(45) Date of Patent: May 29, 2007

(54) ADJUSTING DEVICE FOR A CAMSHAFT

(75) Inventors: Holger Stork, Buehl (DE); Heiko Dell, Buehlertal (DE)

(73) Assignee: Luk Lamellen und Kupplungsbau Beteiligungs KG, Buehl (DE)

( * ) Notice: Subject to any disclaimer, the term of this patent is extended or adjusted under 35 U.S.C. 154(b) by 93 days.

(21) Appl. No.: 11/148,667

(22) Filed: Jun. 8, 2005

(65) Prior Publication Data

US 2005/0274338 A1 Dec. 15, 2005

(30) Foreign Application Priority Data

Jun. 9, 2004 (DE) ..... 10 2004 028 095

(51) Int. Cl.
*F01L 1/34* (2006.01)

(52) U.S. Cl. ..... 123/90.15; 123/90.17; 123/345; 123/406.64; 464/160

(58) Field of Classification Search ..... 123/90.15, 123/90.16, 90.17, 90.18, 345, 346, 347, 348, 123/406.12, 406.58, 406.63, 406.64; 464/1, 464/2, 160

See application file for complete search history.

(56) References Cited

U.S. PATENT DOCUMENTS 5,417,187 A 5/1995 Meyer et al. ..... 123/90.17

5,937,808 A * 8/1999 Kako et al. ..... 123/90.15

FOREIGN PATENT DOCUMENTS

DE 44 08 425 12/1994

* cited by examiner

*Primary Examiner*—Ching Chang
(74) *Attorney, Agent, or Firm*—Davidson, Davidson & Kappel, LLC

(57) ABSTRACT

An adjusting device for the rotational position of the camshaft of a reciprocating piston engine relative to the crankshaft, has an actuator for adjusting the rotational position that is connected into a control circuit. The control circuit has a controller, which is linked to a data memory, in which controller coefficients for a transfer function of the controller are stored. The data memory has at least two memory areas in which various sets of controller coefficients are stored. The control circuit is connectable with the aid of a mode selector, optionally or alternately, in such a way to one of the data memory areas that the controller coefficient set stored in the particular data memory area is used for the control. A device for ascertaining the operating state of the adjusting device and/or of the reciprocating piston engine is connected to the mode selector in such a way that the controller coefficient set used in the particular case for the control is dependent on the operating state.

13 Claims, 2 Drawing Sheets

ADJUSTING DEVICE FOR A CAMSHAFT

Priority is claimed to German Patent Application No. DE 10 2004 028 095.9, filed on Jun. 9, 2004, the entire disclosure of which is incorporated by reference herein.

The present invention is directed to an adjusting device for the rotational position of the camshaft of a reciprocating piston engine relative to the crankshaft, having an actuator for adjusting the rotational position that is connected into a control circuit having at least one controller.

BACKGROUND

An adjusting device of this kind having an actuator that is provided with two mutually engaging gear wheels having helical toothing, is known from the German Patent Application DE 44 08 425 A1. One of the gear wheels is coupled to the camshaft, and the other is driven via a chain by the crankshaft. The gear wheels can be axially shifted towards one another by a hydraulic mechanism, thereby producing a relative torsion between the crankshaft and camshaft due to the helical toothing. The hydraulic mechanism is driven by an actuating signal generated by a control circuit. The hydraulic mechanism is controllable in each instance by one of three values, namely by an early value for adjusting the camshaft toward an early opening of the intake valves of the combustion engine, by a late value for adjusting the camshaft toward a late opening of the intake valves, and by a hold value for holding the active actual angular position. The control circuit executes a control program, which, for each program run, estimates the adjustment speed that will exist at the beginning of the following program run. From this estimated value and the known time response of the camshaft adjustment following the switching of the hold value over to the actuating signal (early or late value), the adjustment angle that the angular position of the camshaft would still change to, if the actuating signal were changed over to the hold value at the beginning of the next program run, is estimated. When the deviation between the estimated value for the adjustment angle and the setpoint angular position of the camshaft lies within a range of tolerance, the switch is made from the early or late value to the hold value. The adjustment speed that will presumably exist at the beginning of the following program run, is estimated from the current adjustment speed, using a first-order transfer function and a final adjustment speed. The final adjustment speed is adapted under specific conditions. In this way, according to the patent application, estimated values for the current position can be determined very precisely even when operating parameters of the hydraulic mechanism change, such as the viscosity of the hydraulic fluid, due to heating of the same. Nevertheless, the control accuracy of the control circuit is still in need of improvement, above all in different operating states. Thus, for example, an overshooting of the signal to be controlled can occur in certain operating situations.

SUMMARY OF THE INVENTION

An of the present invention is to provide an adjusting device of the type mentioned at the outset which, in each instance, will render possible a high control quality in various operating situations.

The present invention provides an adjusting device for the rotational position of the camshaft of a reciprocating piston engine relative to the crankshaft, having an actuator for adjusting the rotational position that is connected into a control circuit having at least one controller, wherein the controller is linked to a data memory, in which controller coefficients for a transfer function of the controller are stored; the data memory has at least two memory areas in which various sets of controller coefficients are stored; the control circuit is connectable with the aid of a mode selector, optionally or alternately, in such a way to one of the data memory areas that the controller coefficient set stored in the particular data memory area is used for the control; and a device for ascertaining the operating state of the adjusting device and/or of the reciprocating piston engine is connected to the mode selector in such a way that the controller coefficient set used in the particular case for the control is dependent on the operating state.

Thus, for various operating situations of the adjusting device and/or of the combustion engine, it is advantageously possible to operate the controller using different controller coefficients, in order to adapt the transfer function of the controller to the particular operating situation and thereby achieve a highest possible control quality in each case. In comparison with a controller having fixed controller coefficients, when such a non-linear controller is used, interference in a signal to be controlled that is to be influenced by the actuator, may be compensated more quickly, while largely avoiding an overshooting. The variable(s) on whose basis the controller coefficients are modified, may be measured variables, or derived from these using suitable algorithms, in consideration of system parameters, such as an electrical resistance, a temperature coefficient, etc.

It is beneficial when the structure of the control circuit is switchable by the mode selector. The controller is then able to be adapted even more effectively to various operating situations of the adjusting device and/or of the combustion engine.

The control circuit is advantageously designed in a first operating mode of the control circuit for controlling the rotor speed of the servomotor and, in a second operating mode, for controlling the torsional angle between the camshaft and the crankshaft. In this context, the first operating mode is preferably used during the starting phase of the combustion engine when a measurement signal for the crankshaft speed is not yet available or is still relatively highly disturbed. As soon as the speed of the combustion engine exceeds a predefined limiting value, and the starting phase is thus ended, the switch is made to the second operating mode in order to control the torsional angle.

One advantageous embodiment of the present invention provides for the control circuit to be switchable by the mode selector between a third and a fourth operating mode, the control circuit in the third operating mode being designed as a multi-position controller and, in the fourth operating mode, for outputting a continuous actuating signal.

In one preferred embodiment of the present invention, the adjusting device has a variator, which is designed as a three-shaft transmission having a fixed-to-the-crankshaft input shaft, a fixed-to-the-camshaft output shaft, and an adjusting shaft, as an actuator, a servomotor being provided which is operatively connected to the adjusting shaft. In this context, the servomotor may be an electronically commutated motor. To control the phase-angle velocity $\theta$ to a setpoint value $\theta_{Tgt}$, speed $\omega_{Cnk}$ of the crankshaft and rotor speed $\omega_{Em}$ of the servomotor are measured with the assistance of sensors. From the thus ascertained measurement signals and a known stationary gear ratio $i_g$ of the variator, a setpoint value $\omega_{Em,Tgt}=(\omega_{Cnk}-i_g\theta_{Tgt})/2$ for rotor speed $\omega_{Em,Tgt}$ of the servomotor is calculated with the assistance of a signal-processing device. Speed $\omega_{Cnk}$ of the crankshaft is advantageously measured by an inductive sensor which detects the teeth of a toothed ring disposed on the crankshaft, for example on a flywheel, as they rotate past. Rotor speed $\omega_{Em}$ of the servomotor is preferably measured with the aid of magnetic field sensors mounted on the stator of the electronically commutated motor which detect the magnetic segments arranged on the periphery of the permanent-magnetic rotor of the electronically commutated motor, as they rotate past.

It is advantageous when the device for determining the operating state has at least one input for a temperature-measurement signal of the combustion engine and/or of the servomotor, and when the device for determining the operating state is designed in such a way that the particular controller coefficient set used for the control is dependent on this measurement signal (these measurement signals). This makes it possible, in particular, to adapt the control circuit to the temperature-dependent viscosity of a transmission oil of the variator and/or to the temperature-dependent electrical resistance of the winding of the servomotor. The temperature of the combustion engine may be measured, for example, using an engine oil temperature gauge and/or a cooling water temperature gauge.

In one useful embodiment of the present invention, the device for determining the operating state has at least one input for a measurement signal and/or one setpoint signal for the torsional angle between the camshaft and the crankshaft, the device for determining the operating state being designed in such a way that the particular controller coefficient set used for the control is dependent on this signal (these signals) and/or on the time rate of change of this signal (these signals). In the case of one adjusting device, in which the adjustable phase-angle range is limited by limit stops, the controller coefficients may then be adjusted in the area of the limit stops in such a way that the control responds relatively slowly to a system deviation, so that an overshooting and thus the danger of damage to a limit stop are safely avoided. At the locations where there is sufficient distance to the limit stops, on the other hand, the controller coefficients may be set in such a way that system deviations are compensated as quickly as possible.

The device for determining the operating state may also have at least one input for a signal representing the rotor speed of the servomotor, the camshaft speed, and/or the crankshaft speed, the device for determining the operating state being designed in such a way that the particular controller coefficient set used for the control is dependent on this signal (these signals). From two of these measurement signals, such as from the rotor speed and the crankshaft speed, as well as from the known stationary gear ratio of the variator, the torsional angle (phase angle) between the camshaft and crankshaft may be determined in each instance, and the controller coefficients may be set as a function of the torsional angle.

It is advantageous when the device for determining the operating state has a memory for buffer-storing at least one value of a controlled variable for the servomotor determined at an earlier point in time by the controller, and when the device for determining the operating state is designed in such a way that the particular controller coefficient set used for the control is dependent on this value (these values). In this manner, it is possible in particular, to provide a hysteresis at low adjustment speeds, in order to reduce the noise at the output of the controller.

In one preferred embodiment of the present invention, the control circuit has at least one limiting device, in particular for the winding current and/or the winding voltage of the servomotor, in the data memory, memory locations being provided, in which limit values for the limiting device(s) are stored; and the limiting device being connectable with the aid of the mode selector, optionally or alternately, in such a way to one of the memory locations that the at least one limit value stored in the particular memory location is used for the limiting operation. Thus, the limit values for the limiting device(s) may be set as a function of the operating state of the adjusting device and/or of the reciprocating piston engine. Thus, for example, in the area of the limit stops, the limit values for the winding current and/or the winding voltage and thus the power output of the servomotor may be selected to be lower in terms of actual amount than at the locations which are more distant from the limit stops, so that, even in the event of a measuring error of an input signal of the controller, damage to the limit stops is safely avoided.

It is especially advantageous when the control circuit has at least one input connection for a precontrol signal that is linked to at least one precontrol device, and when preferably an input connection for a precontrol signal representing the speed of the input shaft of the variator, an input connection for a precontrol signal representing the average load torque of the servomotor, and/or an input connection for a precontrol signal representing an electric voltage (EMF—electromotive force) induced by the rotation of the permanent-magnetic rotor in a winding of the servomotor, are provided. Thus, an even faster and more stable control is made possible by the adjusting device, the control circuit only compensating for those deviations between the signal to be controlled and the setpoint value which are not compensated by the precontrol.

The data memory advantageously has at least two memory areas, in which different sets of precontrol coefficients are stored for the precontrol device(s); the precontrol device(s) being connectable with the aid of a mode selector, optionally or alternately, in such a way to one of these memory areas that the precontrol coefficient set stored in the particular data memory area is used for generating the at least one precontrol signal. Thus, the transfer function(s) of the precontrol(s) may also be adapted to various operating states of the adjusting device and/or of the combustion engine, thereby making possible an even further improved control quality.

BRIEF DESCRIPTION OF THE DRAWINGS

An exemplary embodiment of the present invention is explained in greater detail in the following with reference to the drawing, whose figures show.

DETAILED DESCRIPTION

Figure 1:
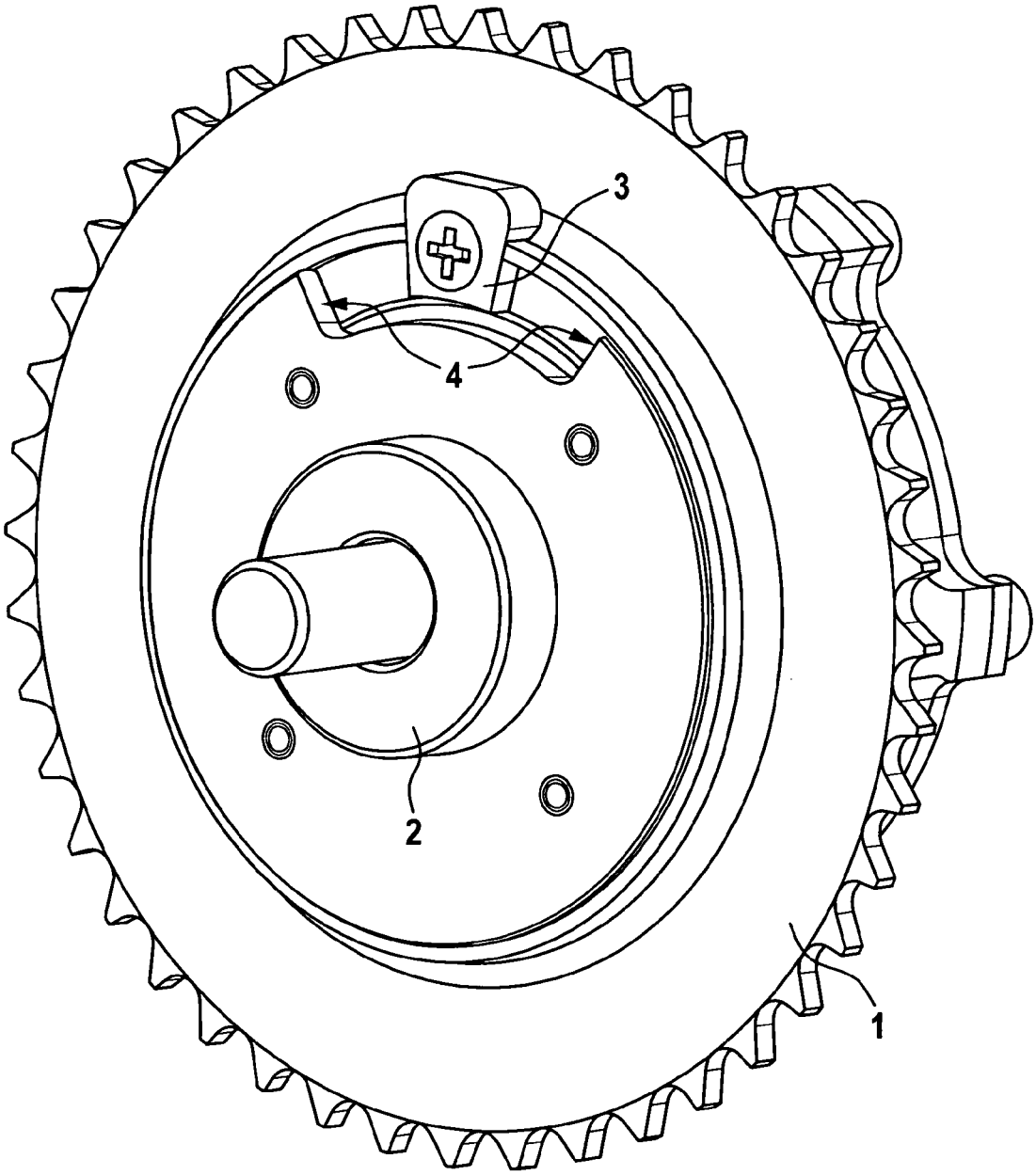
FIG. 1 an adjusting device for adjusting the rotational position of the camshaft of a reciprocating piston engine relative to its crankshaft.

An adjusting device for the rotational position of the camshaft relative to the crankshaft of a reciprocating piston engine (not shown in greater detail in the drawing) has a variator, which is designed as a three-shaft transmission having a fixed-to-the-crankshaft input shaft, a fixed-to-the-camshaft output shaft, and an adjusting shaft. The variator may be an epicyclic gear, preferably a planetary gear.

The input shaft is coupled nonrotatably to a camshaft gear wheel 1 which is operatively connected in a generally known manner via a chain or a toothed belt to a crankshaft gear wheel mounted nonrotatably on the crankshaft of the combustion engine. The output shaft is coupled nonrotatably to camshaft 2 which is only partially illustrated in FIG. 1. The adjusting shaft is coupled nonrotatably to an actuator which is located in FIG. 1 on the rear side of the adjusting device. As an actuator, an electronically commutated motor is provided, which is integrated in the hub of camshaft gear wheel 1.

To limit the torsional angle between the camshaft and the crankshaft, the adjusting device has limit stops made up of a stop element 3 fixedly connected to the input shaft and of counterstop elements 4. Counterstop elements 4 are fixedly connected to camshaft 2 and cooperate in a position of normal operational use with stop element 3.

Figure 2:
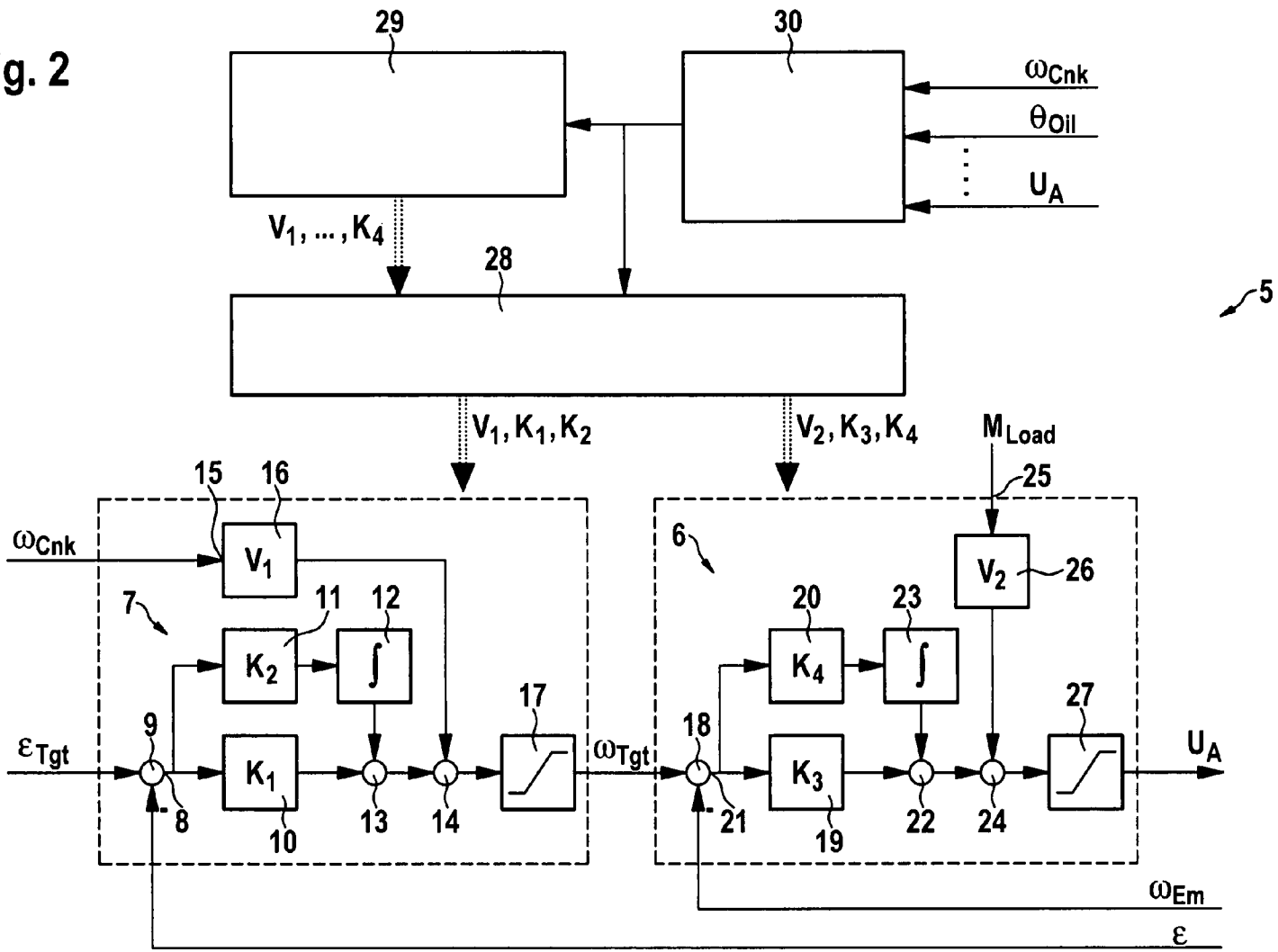
FIG. 2 a signal flow chart of a control circuit of the adjusting device.

To control the torsional angle, the servomotor is connected into a control circuit 5, schematically illustrated in FIG. 2, which has two cascaded controllers, namely a speed controller 6 and, upstream of the same, a phase controller 7.

An input connection of phase controller 7 is linked to an output connection 8 of a first device 9 for determining a system deviation from a setpoint signal $\in_{Tgt}$ and an actual-value signal $\in$ for the adjustment angle of camshaft 2 relative to the crankshaft. In FIG. 2, it is discernible that phase controller 7 has two signal-processing devices 10, 11, which are each linked by their input to output connection 8 of device 9 for determining a system deviation. A first signal-processing device 10 has a first transfer function having first controller coefficients $K_1$; and a second signal-processing device 11 has a second transfer function having second controller coefficients $K_2$. An output of first signal-processing device 10 is linked to a first input of a first summing device 13, and an output of second signal-processing device 11 is linked via a first integration device 12 to a second input of first summing device 13.

An output of first summing device 13 is connected to a first input of a second summing device 14. An input connection 15 for a crankshaft speed signal $\omega_{Cnk}$ is linked via a first precontrol device 16 to a second input of second summing device 14. First precontrol device 16 has a first precontrol transfer function having first precontrol coefficients $V_1$.

An output of second summing device 14 is linked via a first limiting device 17, which limits the output signal to a predefined value range, to an output connection for a speed setpoint signal $\omega_{Tgt}$ for the servomotor.

Speed setpoint signal $\omega_{Tgt}$ is present at a first input of a second device 18 for determining a system deviation from speed setpoint signal $\omega_{Tgt}$ and from an actual-value signal $\omega_{Em}$ for the speed of the servomotor.

Speed controller 6 has two signal-processing devices 19, 20, which are each linked by their input to an output connection 21 of second device 18 for determining the system deviation. A third signal-processing device 19 has a third transfer function having third controller coefficients $K_3$; and a fourth signal-processing device 20 has a fourth transfer function having fourth controller coefficients $K_4$. An output of third signal-processing device 19 is linked to a first input of a third summing device 22, and an output of fourth signal-processing device 20 is linked via a second integration device 23 to a second input of third summing device 22.

An output of third summing device 22 is connected to a first input of a fourth summing device 24. An input connection 25 for a servomotor load signal $M_{Load}$ is linked via a second precontrol device 26 to a second input of fourth summing device 24. Second precontrol device 26 has a second precontrol transfer function having second precontrol coefficients $V_2$.

An output of fourth summing device 24 is linked via a second limiting device 27, which is used for limiting winding voltage $U_A$ to be output to the servomotor to a predefined value range, to an input connection of a control device (not shown in greater detail in the drawing) for the servomotor.

In FIG. 2, it is discernible that speed controller 6 and phase controller 7 are linked via a mode selector 28 to a data memory 29, which has a plurality of data memory areas, in each of which a set of controller coefficients is stored, including first controller coefficients $K_1$, second controller coefficients $K_2$, third controller coefficients $K_3$ and fourth controller coefficients $K_4$. Moreover, in data memory 29, a plurality of data memory areas is provided, in each of which a set of precontrol coefficients is stored, including in each case first precontrol coefficients $V_1$ and second precontrol coefficients $V_2$.

Speed controller 6 and phase controller 7 are connectable with the aid of mode selector 28, optionally or alternately, in such a way to one of the data memory areas that the controller coefficient set stored in the particular data memory area is used for the control, and/or the precontrol coefficient set stored in the particular data memory area is used for the precontrol.

As is also discernible in FIG. 2, a device 30 for ascertaining the operating state of the adjusting device and of the reciprocating piston engine is connected to mode selector 28 and data memory 29 in such a way that the controller coefficient set used in the particular case for the control, and/or the precontrol coefficient set used in the particular case for the precontrol are/is dependent on the operating state. Device 30 for ascertaining the operating state has a plurality of inputs which are linked to sensors for measuring the crankshaft speed, the oil temperature of the combustion engine, the speed of the servomotor, and to an output of second limiting device 27, and an output connection of an engine control for the combustion engine, where a signal is present for an operating mode (engine start/stop, normal operation, emergency operation) of the combustion engine. Device 30 for ascertaining the operating state has a comparator which compares the signals present at the inputs to predefined value ranges. Based on the results of these comparisons, an operating state is determined in each instance, which controls the selection of the controller coefficient sets and precontrol coefficient sets to be used in the particular case.

Mode selector 28 also makes it possible for the structure of the control circuit to be switched over. In a first operating mode of the control circuit, controller coefficients $K_1$, $K_2$ and precontrol coefficients $V_1$ have the value zero, while controller coefficients $K_3$, $K_4$ and precontrol coefficients $V_2$ are not equal to zero. Control circuit 5 then only controls the rotor speed of the servomotor. This operating mode is preferably used during the starting phase of the combustion engine.

In a second operating mode of the control circuit, all controller coefficients $K_1$, $K_2$, $K_3$, $K_4$ and precontrol coefficients $V_1$, $V_2$ are not equal to zero, so that control circuit 5 then controls the torsional angle between camshaft 2 and the crankshaft, and the rotor speed as well. The second operating mode is only used when the speed of the combustion engine exceeds a predefined minimum value.

What is claimed is:

1. An adjusting device for adjusting a rotational position of a camshaft relative to a crankshaft of a reciprocating piston engine, the adjusting device comprising:

a control circuit having at least one controller;

an adjusting actuator connected to the control circuit;

a data memory linked to the control circuit and configured to store a plurality of controller coefficients for a transfer function of the controller, the data memory having at least two controller memory areas for storing sets of the controller coefficients;

a mode selector capable of optionally and alternately connecting the control circuit to one controller memory area of the at least two controller memory areas such that the set of controller coefficients stored in the one controller memory area is used for the control; and an ascertaining device configured to ascertain an operating state of at least one of the adjusting device and the reciprocating piston engine, the ascertaining device being connected to the mode selector so that the set of controller coefficients used for the control is dependent on the operating state.

2. The adjusting device as recited in claim 1, wherein the mode selector is capable of switching the control circuit between a plurality of operational modes.

3. The adjusting device as recited in claim 2, wherein the adjusting actuator includes a servomotor having a rotor speed and wherein the control circuit is configured to control the rotor speed in a first operating mode and to control a torsional angle between the camshaft and the crankshaft in a second operating mode.

4. The adjusting device as recited in claim 2, wherein the control circuit is configured as a multi-position controller in a third operating mode and for outputting a continuous actuating signal in a fourth operating mode.

5. The adjusting device as recited in claim 1, further comprising a variator configured as a three-shaft transmission having an input shaft fixed to the crankshaft, an output shaft fixed to the camshaft, and an adjusting shaft, and wherein the actuator includes a servomotor operatively connected to the adjusting shaft for actuating the variator.

6. The adjusting device as recited in claim 5, wherein the control circuit has at least one input connection linked to at last one precontrol device for receiving a precontrol signal, the precontrol signal at least one of the speed of the input shaft of the variator, an average load torque of the servomotor, and an electric voltage induced by the rotation of a permanent-magnetic rotor in a winding of the servomotor.

7. The adjusting device as recited in claim 1, wherein the adjusting actuator includes a servomotor, wherein the ascertaining device includes at least one input for receiving at least one temperature-measurement signal of at least one of the combustion engine and the servomotor, and wherein the ascertaining device is configured such that the controller coefficient set used for the control is dependent on the at least one temperature-measurement signal.

8. The adjusting device as recited in claim 1, wherein the ascertaining device includes at least one input for receiving at least one of a measurement signal and a setpoint signal for a torsional angle between the camshaft and the crankshaft, and wherein the ascertaining device is configured such that the controller coefficient set used for the control is dependent on at least one of the at least one signal and a time rate of change of the at least one signal.

9. The adjusting device as recited in claim 1, wherein the adjusting actuator includes a servomotor having a rotor, wherein the ascertaining device includes at least one input for receiving a signal representing at least one of a speed of the rotor, the camshaft speed, and the crankshaft speed, and wherein the ascertaining device is configured such that the controller coefficient set used for the control is dependent on the signal.

10. The adjusting device as recited in claim 1, wherein the adjusting actuator includes a servomotor, wherein the controller is configured to determine at least one value of a controlled variable for the servomotor, and wherein the ascertaining device includes a memory for buffer-storing the at least one value and is configured such that the set of controller coefficients used for the control is dependent on the at least one value.

11. The adjusting device as recited in claim 1, wherein the control circuit includes at least one limiting device, wherein the data memory includes at least one limiting memory location configured to store a limit value for the at least one limiting device, and wherein the mode selector is capable of connecting the at least one limiting device optionally and alternately to the to the at least one limiting memory locations so that the at least one limiting device uses the at least one limit value in a limiting operation.

12. The adjusting device as recited in claim 11, wherein the adjusting actuator includes a servomotor, and wherein the at least one limiting device is configured to limit at least one of a winding current and a winding voltage of the servomotor.

13. The adjusting device as recited in one claim 1, wherein the control circuit includes at least one precontrol device, wherein the data memory has a plurality of precontrol memory areas for storing different sets of precontrol coefficients, wherein the mode selector is capable of connecting the at least one precontrol device, alternately and optionally, to one of the plurality of precontrol memory areas such that the precontrol coefficient set stored in the one precontrol memory area is used for generating a precontrol signal.

* * * * *